United States Patent [19]

Matsui

[11] Patent Number: 4,963,883

[45] Date of Patent: Oct. 16, 1990

[54] INK JET RECORDING HEAD HAVING MAGNETIC DISCHARGE AMOUNT CONTROL MEANS

[75] Inventor: Shinya Matsui, Yokohama, Japan

[73] Assignee: Canon Kabushiki Kaisha, Tokyo, Japan

[21] Appl. No.: 415,381

[22] Filed: Sep. 28, 1989

Related U.S. Application Data

[63] Continuation of Ser. No. 128,261, Dec. 1, 1987, abandoned.

[30] Foreign Application Priority Data

Dec. 3, 1986 [JP] Japan ..... 61-286796

[51] Int. Cl.[5] ..... B41J 2/05; B41J 2/175; B41J 2/205

[52] U.S. Cl. ..... 346/1.1; 137/909; 251/129.01; 346/140 R

[58] Field of Search ..... 346/1.1, 140; 137/909; 251/129.01, 129.15

[56] References Cited

U.S. PATENT DOCUMENTS

| | | | |
|---|---|---|---|
| 2,670,749 | 3/1954 | Germer | 137/909 X |
| 3,582,954 | 6/1971 | Skala | 346/140 X |
| 4,251,824 | 2/1981 | Hara et al. | 346/140 R |
| 4,296,421 | 10/1981 | Hara et al. | 346/140 R |
| 4,313,684 | 2/1982 | Tazaki et al. . | |
| 4,317,124 | 2/1982 | Shirato et al. . | |
| 4,376,945 | 3/1983 | Hara et al. . | |
| 4,419,673 | 12/1983 | Ebi | 346/140 X |
| 4,492,966 | 1/1985 | Seki et al. . | |
| 4,494,128 | 1/1985 | Vaught | 346/140 |
| 4,542,391 | 9/1985 | Miyagawa . | |
| 4,560,997 | 12/1985 | Sato et al. . | |
| 4,646,110 | 2/1987 | Ikeda et al. | 346/140 R |
| 4,723,136 | 2/1988 | Suzumura . | |

FOREIGN PATENT DOCUMENTS

| | | |
|---|---|---|
| 0154574 | 9/1982 | Japan . |
| 830329 | 5/1981 | U.S.S.R. . |
| 916856 | 3/1982 | U.S.S.R. . |

*Primary Examiner*—Joseph W. Hartary

*Attorney, Agent, or Firm*—Fitzpatrick, Cella, Harper & Scinto

[57] ABSTRACT

An ink jet recording head is provided with a discharge port for discharging liquid therethrough, a liquid path communicating with the discharge port, an energy generating member provided in the liquid path and generating energy for discharging the liquid, and a discharge amount control disposed on the liquid path on the side opposite to the discharge port with respect to the energy generating member and having a magnetic force generating member and magnetic fluid.

15 Claims, 2 Drawing Sheets

INK JET RECORDING HEAD HAVING MAGNETIC DISCHARGE AMOUNT CONTROL MEANS

This application is a continuation of application Ser. No. 07/128,261 filed Dec. 1, 1987, now abandoned.

BACKGROUND OF THE INVENTION

1. Field of the Invention

This invention relates to an ink jet recording head, and more particularly to an ink jet recording head which is capable of harmonious recording.

2. Related Background Art

The ink jet recording methods have numerous advantages such as the very small noise during recording, ease of color recording and the capability of recording on so-called plain paper, and have been attracting more and more attention in recent years. Above all, the ink jet recording method whereby heat energy is imparted to liquid to produce bubbles in the liquid and the liquid is discharged from an opening by an abrupt variation in the volume of the bubbles to thereby accomplish recording, that is, the ink jet recording method utilizing heat energy, has specially been drawing attention because of the ease with which the apparatus is made compact and the possibility of disposing openings at high density.

Although, the ink jet recording method utilizing heat energy, because it utilizes for discharge a variation in the volume of gas from the production to the extinction of bubbles, can readily cause liquid to be accurately discharged in response to a recording signal, it has sometimes encountered difficulty in accurately controlling the amount of discharged liquid over a wide range and at multiple stages.

So, an ink jet recording head in which a plurality of heat energy generating members are provided for a single discharge port (opening) for liquid discharge and the plurality of heat energy generating members are driven individually or at the same time to thereby accomplish harmonious recording is proposed, for example, in U.S. Pat. No. 4,251,824. However, such a plurality of heat energy generating members, which are provided in a liquid path as a heat generating portion leading to the opening, must be arranged in the direction of extension of the liquid path (the direction of discharge) because the liquid path is minute. Accordingly, the positions of the heat energy generating members with respect to the opening differ from one another, and this has sometimes given rise to a problem in respect of the liquid discharge efficiency. Particularly, when the recording head has been left unused for a while and the viscosity of the liquid near the opening has increased, there has arisen the problem that reliable liquid discharge does not take place when recording is resumed.

SUMMARY OF THE INVENTION

It is an object of the present invention to solve the above-noted problems and to provide an ink jet recording apparatus which can always accomplish sufficient and reliable harmonious recording efficiently.

It is also an object of the present invention to provide an ink jet recording head which is provided with a discharge port for discharging liquid therethrough, a liquid path communicating with said discharge port, an energy generating member provided in said liquid path and generating energy for discharging said liquid, and discharge amount control means disposed on said liquid path rearwardly of said energy generating member with respect to the direction of discharge and having a magnetic force generating member and magnetic fluid.

DESCRIPTION OF THE PREFERRED EMBODIMENTS

In the ink jet recording head of the present invention, by varying the shape of magnetic fluid by a magnetic force generating member, the amount of liquid escaping to the rear of the magnetic fluid when discharging energy is caused to act during the discharge of liquid droplets can be controlled to thereby control the amount of discharge.

The present invention will hereinafter be described in detail with reference to the drawings.

(First Embodiment)

Figure 1:
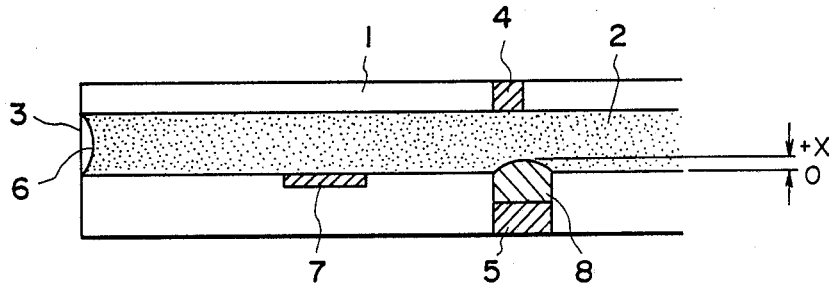
FIG. 1 is a cross-sectional view showing an example of the construction of an ink jet recording head according to the present invention.

FIG. 1 is a schematic enlarged view of the opening portion of the liquid jet recording head according to an embodiment of the present invention.

In FIG. 1, the reference numeral 1 designates a liquid path comprising a fine glass tube or the like communicating with an opening 3. Liquid 2 such as ink is directed into the liquid path 1. The liquid 2 forms a meniscus 6 in the opening 3. The reference numeral 7 denotes a heat generating element provided in the liquid path 1. When a pulse voltage conforming to a printing command is applied to the heat generating element 7, the liquid 2 near the opening 3 is heated and abruptly expanded and the liquid 2 provides liquid droplets which are discharged from the opening 3, whereby dot recording is accomplished.

The reference numerals 4 and 5 designate magnetic force generating members provided at a short distance rearwardly of the heat generating element 7 in the liquid path 1, and the reference numeral 8 denotes magnetic fluid disposed on the magnetic force generating member 5. In the present invention, the flow path resistance of the liquid 2 is varied by varying the shape of the magnetic fluid 8.

That is, the magnetic fluid 8 is deformed or shifted toward the interior of the liquid path across the direction of liquid flow (see FIG. 3A) when a voltage is applied to the magnetic force generating member 4, and during this deformation, the flow path resistance of the liquid 2 is varied. Of course, if the application of the voltage to the magnetic force generating member 4 is stopped, the magnetic fluid 8 will quickly restore its original state (see FIG. 3C).

Also, if a fluid which is not soluble in the liquid 2 is employed as the magnetic fluid 8, it will be unnecessary to provide a separating film between the magnetic fluid 8 and the liquid 2.

Under such a construction, the present embodiment adopts a system wherein the magnetic fluid 8 is suitably deformed to set the flow path resistance of the liquid 2 to a desired value and in this state, a voltage is applied to the heat generating element 7 to discharge the liquid 2, thereby controlling the diameter of liquid droplets. More specifically, a voltage of a predetermined value is applied to the magnetic force generating member 4 for a predetermined time and the time from a point of time at which the application of said voltage is terminated until a pulse voltage is applied to the heat generating element 7 is varied to thereby control the diameter of liquid droplets.

Figures 2A, 2B, 2C:
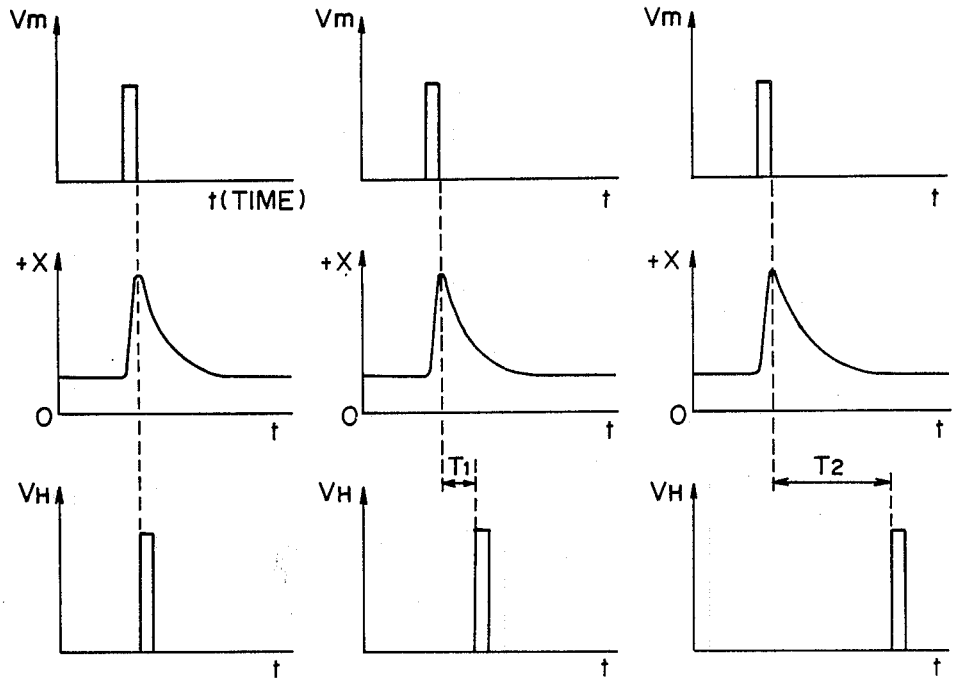
FIGS. 2A–2C illustrate the timings at which the recording head shown in FIG. 1 is driven.

The operation of the present embodiment will now be described specifically with reference to FIGS. 2A–2C and 3A–3C. In FIGS. 2A–2C, the ordinate of each uppermost graph represents the drive voltage (Vm) for the magnetic force generating member, each graph in the middle stage shows the position of the liquid path surface as 0 and shows the displacement (+X) of the uppermost point of the magnetic fluid 8 in the ordinate with the upward direction in FIG. 1 as the positive, and each lowermost graph shows the drive voltage ($V_u$) for the heat generating element. Also, the abscissas of all the graphs of FIGS. 2A–2C represent time (t).

Figure 3A:
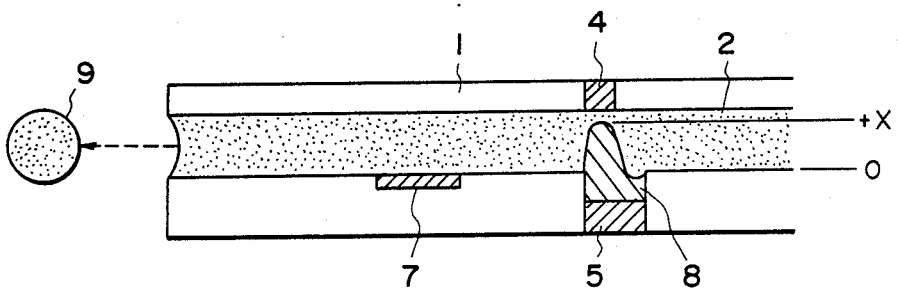
FIGS. 3A–3C illustrate the operation of the recording head of FIG. 1 when driving is effected at the timings shown in FIGS. 2A–2C.

That is, when as shown in the uppermost state of FIG. 2A, a pulse voltage of a predetermined voltage value is applied to the magnetic force generating member 4 in response to a printing command, the magnetic fluid 8 is deformed as shown in FIG. 3A with a result that the flow path resistance of the liquid 2 becomes great. When the power supply is stopped thereafter, the magnetic fluid 8 shifts to the state of FIG. 3C via the state of FIG. 3B, and in that process, the flow path resistance of the liquid 2 varies in conformity with the lapse of time after the application of the voltage to the magnetic force generating member 4.

That is, if a predetermined voltage is applied to the heat generating element 7 at $T_1$ and $T_2$ ($T_1 < T_2$) immediately after the application of the voltage to the magnetic force generating member 4, the liquid 2 can be discharged with the amount of the liquid 2 discharged, i.e., the diameter of liquid droplets, varied.

(A) A case or mode of operation where a voltage is applied to the heat generating element 7 immediately after the application of the voltage to the magnetic force generating member (FIGS. 2A and 3A):

If a voltage is applied to the heat generating element 7 when the magnetic fluid 8 is of the shape as shown in FIG. 3A, the liquid 2 is heated and abruptly expanded to form a liquid droplet 9. Since at this time, the flow path resistance is great due to the magnetic fluid 8, the amount of liquid 2 escaping to the rear of the interior of the liquid flow path 1 becomes small. As a result, a large liquid droplet is formed.

It is also possible to vary the shape of the magnetic fluid 8 so that the magnetic fluid 8 contacts the upper surface, i.e., the magnetic force generating member 4, but it is preferable with the response speed of the magnetic fluid 8 taken into account to vary the shape of the magnetic fluid 8 to such an extent that the magnetic fluid does not contact the upper surface.

Figure 3B:
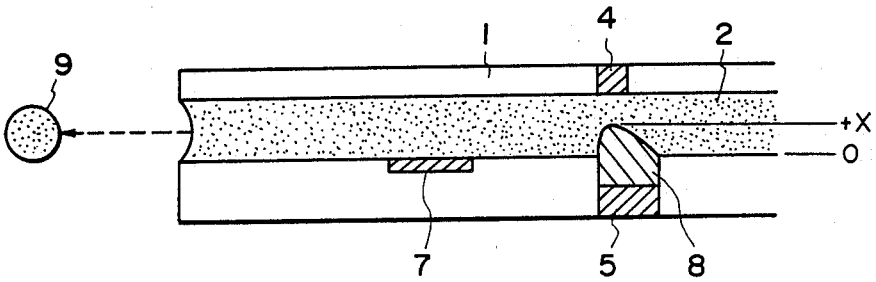

(B) A case or mode of operation where a voltage is applied to the heat generating element 7 in time $T_1$ after the application of the voltage to the magnetic force generating member 4 (FIGS. 2B and 3B):

When the shape of the magnetic fluid 8 is such as shown in FIG. 3B, the resistance by the magnetic fluid 8 becomes small as compared with that in the case (A) and accordingly, a small liquid droplet 9 is formed as compared with the case (A).

Figure 3C:
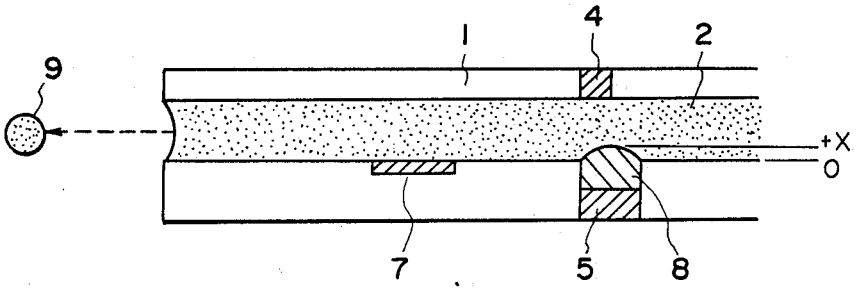

(C) A case or mode of operation where a voltage is applied to the heat generating element 7 in time $T_2$ after the application of the voltage to the magnetic force generating member 4 (FIGS. 2C and 3C):

When the shape of the magnetic fluid is such as shown in FIG. 3C, the flow rate resistance by the magnetic fluid 8 becomes smallest and accordingly, the amount of liquid 2 escaping rearwardly becomes greatest. As a result, a liquid droplet 9 of the smallest diameter is obtained. That is, in this case, there is formed a liquid droplet 9 of the same size as that when no voltage is applied to the magnetic force generating member 4.

When the liquid droplet 9 is to be formed by a voltage being thus applied to the heat generating element 7, the amount of liquid 2 escaping to the rear of the liquid flow path 1 is controlled by varying the shape of the magnetic fluid, whereby the size of the liquid droplet 9 can be controlled. Particularly, the advantage of varying the shape of the magnetic fluid by a magnetic force is the very quick responsiveness, as compared, for example, with a method of moving a solid magnetic material by a magnetic force to thereby control the flow rate.

Also, the distance between the heat generating element 7 and the magnetic fluid 8 and the distance between the heat generating element 7 and the magnetic force generating members 4 and 5 are small, and this is desirable in that it becomes easy to control the amount of liquid 2 escaping rearwardly and that the size of the liquid droplet is controlled.

Further, when a voltage is applied to the magnetic force generating member 5 immediately after a voltage has been applied to the heat generating element 7, the magnetic fluid 8 quickly restores the state shown in FIG. 3C and therefore, it is also possible to provide higher responsiveness to the variation in the shape of the magnetic fluid 8.

As described above, according to the present embodiment, when the flow rate resistance rearward of the heat generating element provided in the liquid path is controlled and the amount of liquid is of a value for which the desired diameter of liquid droplets is obtained, the application of a voltage to the heat generating element is effected so as to control the diameter of liquid droplets discharged and therefore, the analog modulation which expresses the density by a variation in dot diameter becomes possible, and the quality of image including a halftone of high quality can be obtained by a slight dot density and reliability can also be improved and a great reduction in cost can be realized.

(Second Embodiment)

The first embodiment described above controls the timing at which the heat generating element is driven after the magnetic force generating members have been driven, whereas in the present embodiment, the timing of the application of a pulse voltage to the heat generating element 7 is fixed and the timing at which voltage is applied to the magnetic force generating member 4 is varied to thereby control the diameter of liquid droplets.

The control effected in the present embodiment has also led to the obtainment of an effect entirely similar to that of the above-described first embodiment.

The magnetic fluid used in the present invention may be any generally known magnetic fluid which will not mix with the liquid (ink) used for recording.

For example, where the recording liquid is aqueous magnet fluid with an oleaginous base can generally be used, and where the recording liquid is oleaginous, magnetic fluid water base can generally be used.

Also, in order that the magnetic fluid and the recording liquid may not mix together when the power source of the apparatus is OFF, the magnetic fluid must have a certain degree of viscosity. Basically, it is desirable to choose magnetic fluid having a value greater (or smaller) than the viscosity (or fluidity) of the recording liquid. Although, depending on the structure of the recording head and the co-solubility of magnetic fluid and recording liquid, choice is possible in many relations.

Specifically, the magnetic fluid usable in the recording head of the present invention may suitably be a suspension provided by applying the surface treatment by an interface activator (such as oleic acid) to fine particles of a magnetic material having a diameter of the order of 100Å (consisting of materials chosen from among iron, nickel, cobalt and compounds or alloys thereof such as, for example, magnetite ($FeO.Fe_2O_3$) as one of ferrite materials) and dispersing the fine particles in water (aqueous liquid), fatty liquid or an oleaginous solution such as kerosene.

Also, the magnetic force generating members may most preferably be electromagnets in that their magnetic forces can be controlled, but permanent magnets can also be used if they can vary the distance to the magnetic fluid.

As described above, according to the present invention, there can be realized an ink jet recording head which can efficiently accomplish sufficient and reliable harmonious recording.

I claim:

1. An ink jet recording head comprising:

a discharge port for discharging liquid to be utilized for recording therethrough;

a liquid path communicating with said discharge port;

an energy generating member in said liquid path for generating energy to discharge the liquid; and control means for controlling the amount of liquid discharged through said discharge port by varying the resistance to liquid flow in said liquid path, wherein said control means is disposed in said liquid path upstream of said energy generating member with respect to said discharge port and includes a magnetic fluid different from and which does not mix with the liquid and a magnetic force generating member for generating a magnetic force to shift said magnetic fluid in a direction across that in which the liquid moves in said liquid path and thereby vary the resistance to liquid flow in said liquid path.

2. An ink jet recording head according to claim 1, wherein said energy generating member is a heat generating element which generates heat energy for forming a droplet of the liquid.

3. An ink jet recording head according to claim 2, wherein said heat generating element is an electro-thermal converting member.

4. An ink jet recording apparatus according to claim 2, wherein said control means is adapted to control the cross-sectional area of said liquid path to vary the size of the liquid droplet discharged from said discharge port.

5. An ink jet recording head according to claim 1, wherein said magnetic force generating member is an electromagnet.

6. An ink jet recording head according to claim 1, wherein said magnetic fluid is oleaginous.

7. An ink jet recording method for discharging a liquid droplet by driving an energy generating member disposed in a liquid path supplied with liquid and communicating with a discharge port for discharging liquid therethrough to be utilized for recording, the method comprising the steps of:

providing discharge amount control means for controlling the size of the liquid droplet discharged through said discharge port by varying the resistance to liquid flow in said liquid path, including a magnetic fluid different from and which does not mix with the liquid and a magnetic force generating member disposed in said liquid path upstream of said energy generating member with respect to said discharge port for generating a magnetic force to shift said magnetic fluid in a direction across that in which the liquid moves in said liquid path when a voltage is applied to said magnetic force generating member and thereby vary the resistance to flow liquid in said liquid path;

applying a voltage to said magnetic force generating member to generate a magnetic force to shift said magnetic fluid; and then driving said energy generating member to discharge a liquid droplet.

8. An ink jet recording method according to claim 7, wherein said energy generating member is operable in a first mode in which said energy generating member is driven after a first time interval substantially equal to zero after termination of the voltage application to said magnetic force generating member, so that said magnetic fluid presents a first flow path resistance when said energy generating member is driven to discharge a droplet of a first predetermined size.

9. An ink jet recording method according to claim 8, wherein said energy generating member is operable in a second mode in which said energy generating member is driven after a second time interval longer than the first time interval after termination of the voltage application to said magnetic force generating member, so that said magnetic fluid presents a second flow path resistance smaller than the first flow path resistance when said energy generating member is driven to discharge a droplet of a second predetermined size smaller than the first predetermined size.

10. An ink jet recording method according to claim 9, wherein said energy generating member is operable in a third mode in which said energy generating member is driven after a third time interval longer than the second time interval after termination of the voltage application to said magnetic force generating member so that said magnetic fluid presents a third flow path resistance smaller than the second flow path resistance when said energy generating member is driven to discharge a droplet of a third predetermined size smaller than the second predetermined size.

11. An ink jet recording method according to claim 7, wherein said energy generating element is a heat generating element for generating thermal energy and the liquid droplet is formed by a rapid pressure change in the liquid upon driving of said heat generating element.

12. An ink jet recording apparatus including an ink jet recording head comprising:

a discharge port for discharging a liquid droplet to be utilized for recording;

a liquid path communicating with said discharge port;

an energy generating member in said liquid path for generating energy to discharge the liquid; and control means for controlling the size of the liquid droplet discharged through said discharge port by varying the resistance to liquid flow in said liquid path, wherein said control means is disposed in said liquid path upstream of said energy generating member with respect to said discharge port and includes a magnetic fluid disposed on one surface of the liquid path, said magnetic fluid being a fluid different from and which does not mix with the liquid, and a magnetic force generating member for generating a magnetic force to shift said magnetic fluid in a direction across that in which the liquid moves in said liquid path but not a sufficient distance to contact the opposite surface of said liquid path, and thereby vary the resistance to liquid flow in said liquid path.

13. An ink jet recording apparatus according to claim 12, wherein said energy generating element is a heat generating element for generating thermal energy and the liquid droplet is formed by a rapid pressure change in the liquid in the vicinity of said heat generating element.

14. An ink jet recording apparatus including an ink jet recording head comprising:

a discharge port for discharging liquid to be utilized for recording;

a liquid path communicating with said discharge port;

an energy generating member in said liquid path for generating energy to discharge the liquid; and a control means for controlling the amount of liquid discharged through said discharge port by varying the resistance to liquid flow in said liquid path, wherein said control means is disposed in said liquid path upstream of said energy generating member with respect to said discharge port and includes a magnetic fluid different from and which does not mix with the liquid and a magnetic force generating member for generating a magnetic force upon application thereto of a voltage to shift said magnetic fluid in a direction across that in which the liquid moves in said liquid path and thereby vary the resistance to liquid flow in said liquid path, said control means being operable in a first mode in which said energy generating element is driven at a first time interval after termination of the voltage application to said magnetic force generating member to present a first flow resistance and thereby discharge a first predetermined about of liquid, and in a second mode in which said energy generating element is driven at a second time interval after such voltage application to present a second flow resistance different from the first flow resistance to discharge a second predetermined amount of liquid different from the first predetermined amount.

15. An ink jet recording apparatus according to claim 14, wherein said energy generating member is a heat generating element for generating thermal energy and liquid is discharged by a rapid pressure change in the liquid in the vicinity of said heat generating element.

* * * * *

UNITED STATES PATENT AND TRADEMARK OFFICE

CERTIFICATE OF CORRECTION

PATENT NO. : 4,963,883

DATED : October 16, 1990

INVENTOR(S) : Shinya MATSUI

It is certified that error appears in the above-identified patent and that said Letters Patent is hereby corrected as shown below:

COLUMN 1:

Line 16, "the" should be deleted; and
Line 29, "Although," should read --Although--.

COLUMN 3:

Line 19, "drive voltage ($V_u$)" should read --drive voltage ($V_H$)--.

COLUMN 4:

Line 68, "magnet" should read --magnetic--.

COLUMN 5:

Line 9, "Although," should read --However,--.

UNITED STATES PATENT AND TRADEMARK OFFICE

CERTIFICATE OF CORRECTION

PATENT NO. : 4,963,883 Page 2 of 2

DATED : October 16, 1990

INVENTOR(S) : Shinya MATSUI

It is certified that error appears in the above-identified patent and that said Letters Patent is hereby corrected as shown below:

COLUMN 8:

Line 1, "a" should be deleted; and
Line 19, "about" should read --amount--.

Signed and Sealed this

Twenty-first Day of July, 1992

*Attest:*

DOUGLAS B. COMER

*Attesting Officer*

*Acting Commissioner of Patents and Trademarks*